US006942070B2

(12) United States Patent
Ramseier et al.

(10) Patent No.: US 6,942,070 B2
(45) Date of Patent: Sep. 13, 2005

(54) EMERGENCY BRAKING AND SHOCK ABSORBING DEVICE FOR A LIFT OR SUSPENDED LOAD

(75) Inventors: Jean-Pierre Ramseier, Chardonne (CH); Andrzej Wacinski, Bex (CH)

(73) Assignee: Plumettaz SA, Bex (CH)

( * ) Notice: Subject to any disclaimer, the term of this patent is extended or adjusted under 35 U.S.C. 154(b) by 0 days.

(21) Appl. No.: 10/466,159

(22) PCT Filed: Jan. 14, 2002

(86) PCT No.: PCT/CH02/00021

§ 371 (c)(1),
(2), (4) Date: Oct. 23, 2003

(87) PCT Pub. No.: WO02/057176

PCT Pub. Date: Jul. 25, 2002

(65) Prior Publication Data

US 2004/0074706 A1 Apr. 22, 2004

(30) Foreign Application Priority Data

Jan. 18, 2001 (CH) ..... 68/01
Jun. 28, 2001 (CH) ..... 1190/01

(51) Int. Cl.[7] ..... B66C 15/02; B66C 5/12

(52) U.S. Cl. ..... 188/65.1; 187/391; 182/142; 182/18

(58) Field of Search ..... 182/3–9, 18, 141, 182/142, 148, 223, 144, 146, 234; 187/288, 373, 374, 391, 393, 394; 188/65.1–65.5; 254/391, 392, 267, 371; 242/419.1

(56) References Cited

U.S. PATENT DOCUMENTS

| | | | | | |
|---|---|---|---|---|---|
| 4,498,563 | A | | 2/1985 | Trahan | 188/65.1 |
| 5,366,045 | A | | 11/1994 | Liston | 187/376 |
| 5,735,507 | A | * | 4/1998 | Sierra Escudero et al. | 254/391 |
| 6,688,582 | B1 | * | 2/2004 | Wacinski | 254/297 |
| 2004/0074706 | A1 | * | 4/2004 | Ramseier et al. | 188/65.1 |

FOREIGN PATENT DOCUMENTS

| | | | | |
|---|---|---|---|---|
| EP | 0 155 217 A1 | | 9/1985 | B66D/3/10 |
| EP | 0 686 595 A1 | | 12/1995 | B66C/15/02 |
| FR | 2 397 358 | | 2/1979 | B66B/5/16 |
| JP | 55-84729 | * | 6/1980 | |
| JP | 8-245132 | * | 9/1996 | |
| JP | 9-140020 | * | 5/1997 | |
| JP | 9-215145 | * | 8/1997 | |
| JP | 11-209022 | * | 8/1999 | |
| SU | 1470653 A1 | | 4/1989 | B66C/15/02 |
| WO | WO 01/38217 A1 | * | 5/2001 | |
| WO | WO 02/057176 A1 | * | 7/2002 | |

* cited by examiner

*Primary Examiner*—Douglas C. Butler
(74) *Attorney, Agent, or Firm*—Pearne & Gordon LLP

(57) ABSTRACT

The load or the working platform is suspended and displaced by at least a pair of cables whereof the stresses are equivalent. Advantageously, each pair of cables is controlled by an emergency braking device comprising means for detecting the slack strand on one of the cables of the pair and controlling a braking on the other cable of the pair. So as to avoid an impact during the emergency braking, the working platform is also equipped with a shock absorbing device.

16 Claims, 6 Drawing Sheets

EMERGENCY BRAKING AND SHOCK ABSORBING DEVICE FOR A LIFT OR SUSPENDED LOAD

BACKGROUND OF THE INVENTION

The present invention is directed to an emergency braking device for any vehicle, load or object pulled or secured by, at least, two cables subjected to tensile loads, which are identical under normal operating conditions. It is further directed to a shock absorbing device, which can be associated with the former device or with any other emergency braking device. Also, the invention is directed to any vehicle, load or object, which is pulled or secured by, at least, one cable, which is provided with an emergency braking device and which can be provided with a shock absorbing device.

PRIOR ART

A number of systems for imparting a movement of translation along an oblique plane or along a vertical direction are known, wherein a vehicle, a working platform or a load of any type is pulled by, at least, two cables. Cable cars, carriages or funiculars travelling in an oblique plane, as well as lifts, freight elevators, working platforms for maintenance work on facades or crane hooks moving vertically are advantageously provided with a pulling system including at least one pair of cables, both of said cables being subjected to a tensile load which is identical under normal operating conditions.

Application WO 01/38217 describes an elevator or a working platform for maintenance work on facades, which is provided, at each one of its ends, with an embarked winding gear for two cables and with differential means for balancing the tensile load on these two cables. Other means for balancing the tensile load on the two cables can be used, for example the working platform or the vehicle to be pulled can be suspended on, at least, one cable passing over a pulley or through a pulley block fixed to the vehicle or to the working platform, thus providing at least one pair of suspension strands. In the following description, as well as in the claims, the term "cables of a pair of cables" will be used even in the case of a pair of strands of the same cable. Depending on the configuration of the suspended object, the cables envisaged here, could be cables used for pulling said object or cables designed for solely ensuring the emergency braking of the object, in which case the pulling means are of another type.

In order to guarantee effectively the safety of the vehicle or of the working platform, it is necessary to install therein an emergency braking device which can be actuated, in the case of a rupture of a cable of a pair of cables.

Different emergency braking devices have been proposed for use in vehicles or in working platforms as those described above. In particular, devices are known for detecting an excessive speed and for, consequently, actuating a braking device. The reaction time of these devices is long, and the vehicle or the working platform undergoes a rather significant fall before being brought to a halt. Other devices require an electrical power supply for their operation and a simultaneous rupture of the power supply line and of a cable could be disastrous. Furthermore, one must take into account the mode of action of the braking device, in particular, on which element it operates. Most of the vehicles or of the working platforms described include a fixed element, which is a carrier cable or a rail, which is arranged along the travel path of the vehicle and on which the jaws of the emergency braking device can be clamped. If the only function of such a structural fixed element is to enable an emergency braking, this increases the cost of the emergency braking device.

Furthermore, in the case of a rupture of a cable, the mass formed by the working platform, the winding gears and also the staff and the material onboard the working platform is abruptly accelerated up to the point where the emergency braking mechanism functions. In view of the fact that, generally, the emergency braking device operates through the clamping or the gripping of the still intact cable by jaws, this device brings about the halt extremely abruptly, with a very strong deceleration. The shock associated with this bringing to the platform to a halt, could be harmful both to the staff and the materiel and equipment on the working platform, should it occur.

Accordingly, the first objective of the invention is to provide an emergency braking device which is capable of bringing to a halt any object, load or vehicle pulled or secured by, at least, one pair of cables, both subjected to an identical tensile load and which is improved, by comparison with known devices.

A further objective of the invention is to provide an emergency braking device as described above which is capable of functioning without an external power supply.

A further objective of the invention is to provide an emergency braking device as described above which requires no fixed structural element for its functioning.

Yet a further objective of the invention is to provide an emergency braking device as described above which is of a simple design, so as to be capable of functioning reliably and rapidly, while limiting maximally the fall of the object, of the load or of the vehicle, pulled or secured.

A further objective of the invention is to provide a shock absorbing device capable of eliminating the above-mentioned problems, encountered in emergency braking.

Yet a further objective of the invention is to provide a vehicle including, at least, one emergency braking device as described above.

Yet a further objective of the invention is to provide a vehicle including an emergency braking device as well as a shock absorbing device.

The explanation given hereafter of several alternate versions of the shock absorbing devices, and subsequently of a preferred embodiment of an emergency braking device according to the invention, further includes the description of several other advantages of these devices. The explanation is made with reference to the appended drawing, including figures, wherein:

DESCRIPTION OF THE PREFERRED EMBODIMENT

The description hereafter concerns an exemplary case, where the object of the invention is a working platform for maintenance work on facades of buildings. Those skilled in the art will understand that it is possible to apply the different embodiments of the invention to other types of vehicles, loads or objects.

Figure 1:
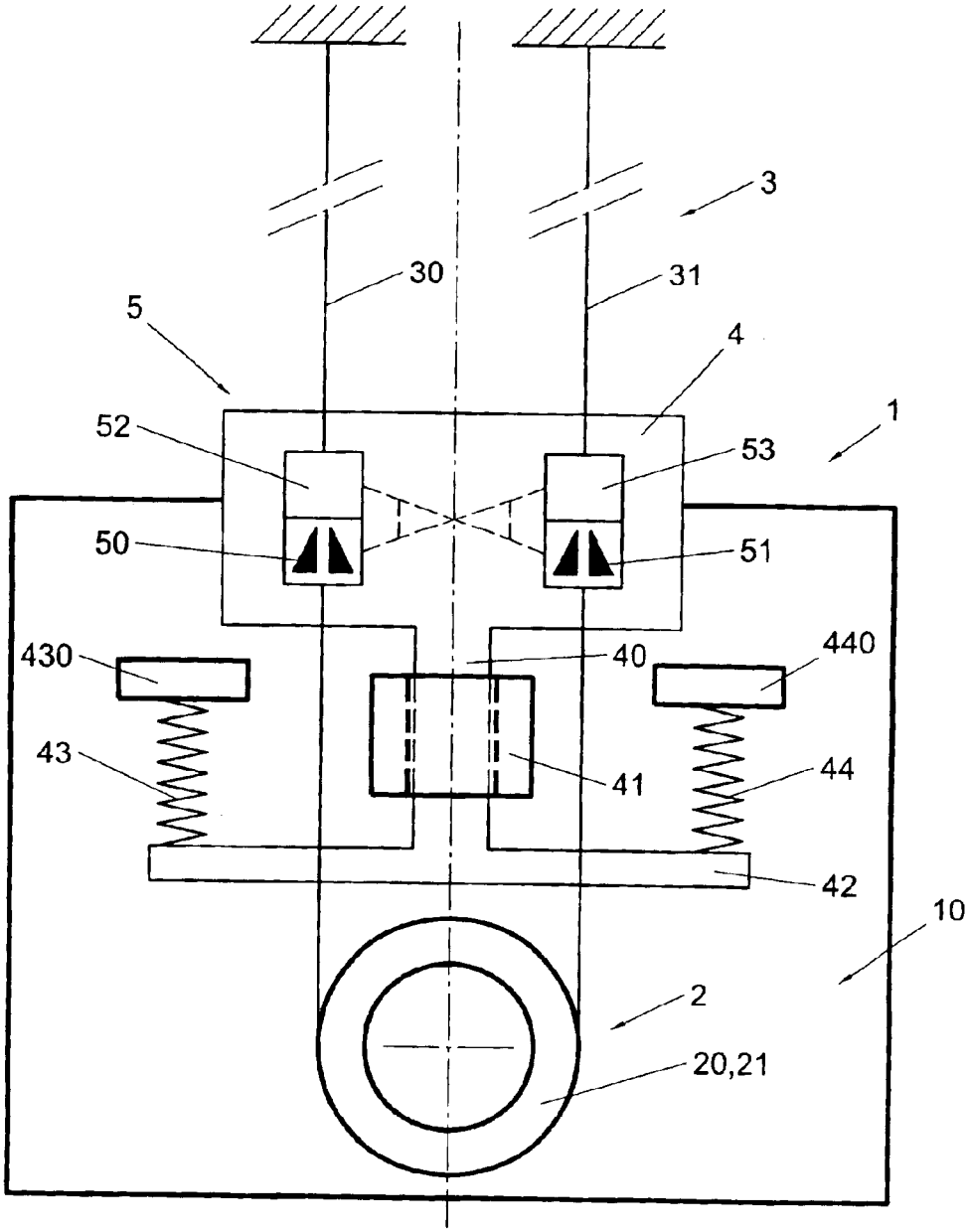
FIG. 1 represents a portion of a load, here a suspended working platform, equipped with a shock absorbing device according to a first embodiment.

FIG. 1 shows a working platform 1 wherein numeral 10 designates the face of a first end thereof. In this figure, the working platform 1 includes a winding gear 2 of which are illustrated here only the two drums 20, 21 designed each one for winding up or for unwinding one of the cables 30 or 31 of a plurality of suspension cables 3. The ends of the cables 30, 31 opposite to those wound around the drums 20, 21 are fastened to fixed points, for example a suspension beam. Such a working platform corresponds to that described in application WO 01/38217 mentioned previously.

The working platform 1, which could be here a suspended load of any type, includes furthermore a plate or a mount 4 provided with an extension acting as a slider 40 mounted slidably inside a channel acting as a guide 41, the latter being fixed to the wall 10 of the working platform 1. Accordingly, the mount 4 is capable of a movement, within a determined range, along the vertical direction and relatively to the working platform 1. The end of the slider 40 opposite to that fixed to the mount 4 is fixed to a crossbeam 42, of which each end supports a shock absorber 43, 44 operating between said end of the crossbeam and a point of fixation 430, 440 integral with the wall 10 of the working platform 1.

An emergency braking device 5, of which a preferred embodiment will be described later in detail, includes a first braking device 50, capable of blocking the cable 30, as well as a second braking device 51 acting on the cable 31. Each one of the braking devices 50 and 51, is actuated by a detector, respectively 52 and 53. Generally speaking, the detectors 52 and 53 can be of any known type, detecting, for example, the loss of a tensile load, a slack strand or an excessive speed and, in particular, be of a mechanical, of an electronic or of an electromechanical type. One of the detectors can be of a first type, for example a detector detecting a slack strand, whereas the other detector is of a different type, for example detecting an excessive speed. In order to improve safety, each detector can be designed to initiate, in case of an incident, the emergency braking of the two braking devices.

The mount 4 is illustrated here as being comprised of a plate carrying the different components described, on one face thereof; actually, a casing will preferably cover the mount, in order to protect its components.

The other end of the working platform 1 is equipped in the same manner.

In the case of a rupture of a cable 30, 31 at any location of the length of said cable, the detector of a rupture of the cable designed for detecting a slack strand, or the loss of a tensile load and/or the detector mounted on the other cable designed for detecting an excessive speed, act or acts to actuate the emergency braking devices 59 and/or 51.

After the rupture of a cable of the working platform 1, the same begins to fall and the actuation of the emergency braking device on the remaining cable stops immediately the fall of the working platform. In the case of a working platform according to prior art and not equipped with a shock absorbing device, the shock arising from the working platform being brought to a halt, is likely to harm the staff operating on the working platform and/or damage the equipment installed thereupon.

Conversely, in the case of a working platform such as that illustrated here and provided with a mount 4 carrying the braking devices 5, mounted slidably on the working platform 1 and connected to the same via shock absorbers 43 and 44, the shock associated with the bringing of the working platform to a halt is strongly dampened, which is favourable both for the staff and for the material on board.

FIG. 1 shows that that the mount 4 is connected to the working platform 1 by two shock absorbers 43, 44 functioning in compression. Quite obviously, one shock absorber only or more than two shock absorbers could be provided, which could function in compression as described here, or in extension. The shock absorber or absorbers can be of any known type, for example hydraulic, fluid or gas operated, relying on springs or on the compression of elastomers in the case of shock absorbers functioning in compression.

In this preferred embodiment of the invention shown in FIG. 1, only the emergency braking device 5 is mounted on the movable mount 4.

Figure 2:
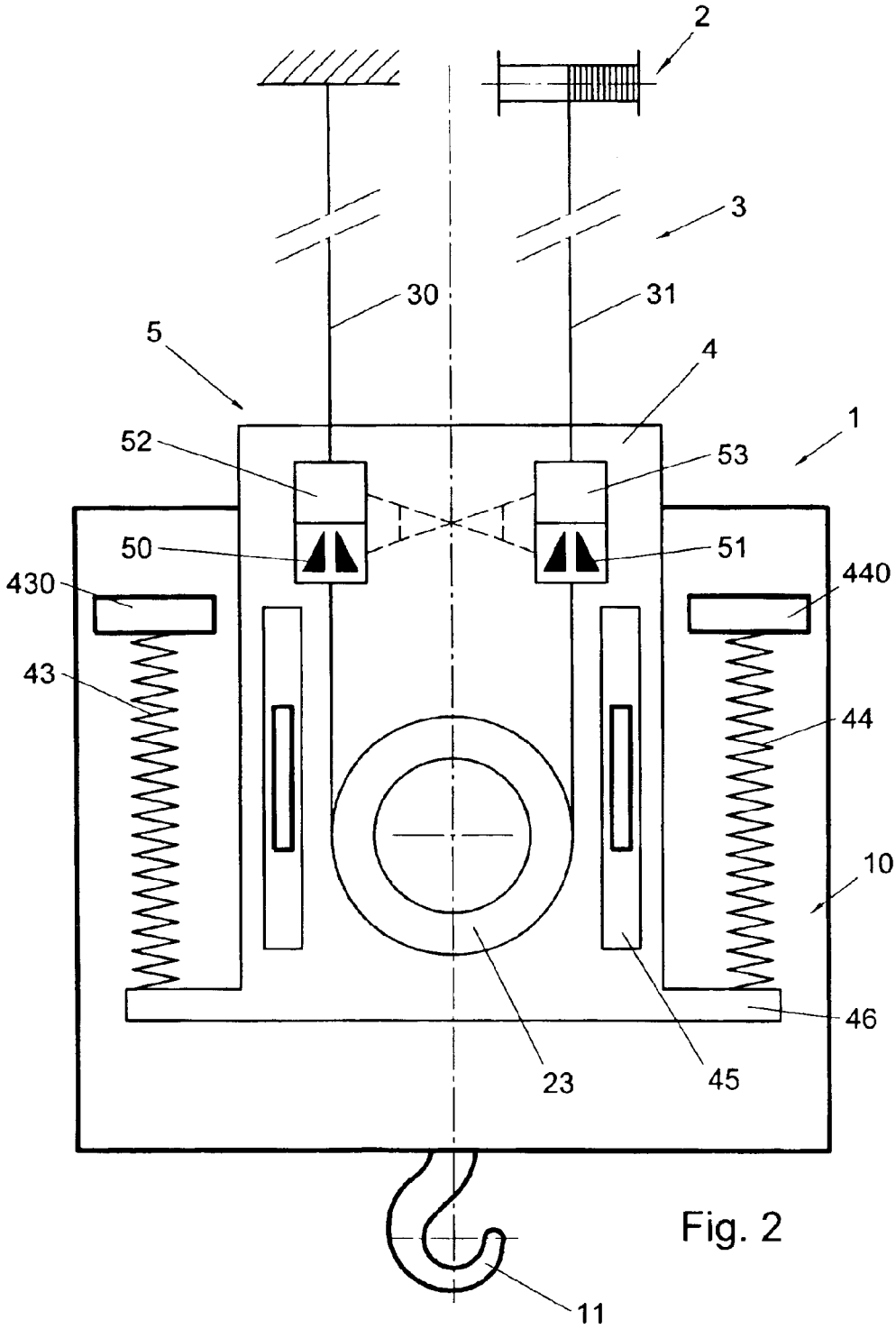
FIG. 2 represents the same load equipped with a shock absorbing device according to a second embodiment.

Firstly, FIG. 2 shows an alternate version of the driving device of the working platform, wherein the winding gear 2 is not positioned any more on the working platform 1, but on a fixed part of the building in front of which the working platform is moved. In this case, the two cables 30 and 31 are the two strands of the same cable passing over a return pulley 23, mounted on the working platform 1 as described hereafter.

Furthermore, this figure shows a second embodiment of the shock absorbing device, wherein the emergency braking device 5 as well as the return pulley 23 are mounted on the movable mount 4. A guide means 45 makes possible a relative motion of the mount 4 with respect to the working platform or the suspended load 1. As previously, the mount 4 is provided with a crossbeam 46, of which the two ends are connected to the anchoring points 430 and 440 of the working platform 1, via the shock absorbers 43 and 44. The operations of the device are totally identical to those described previously, the difference between the two embodiments lying in the fact that, in the case of the second embodiment of FIG. 2, the mass which is subjected to a shock when brought to a halt is greater than in the first embodiment, because more elements are mounted on the mount 4.

Furthermore, FIG. 2 shows a hook 11, to clearly indicate that the devices according to the invention can be applied to any suspended load.

Figure 3:
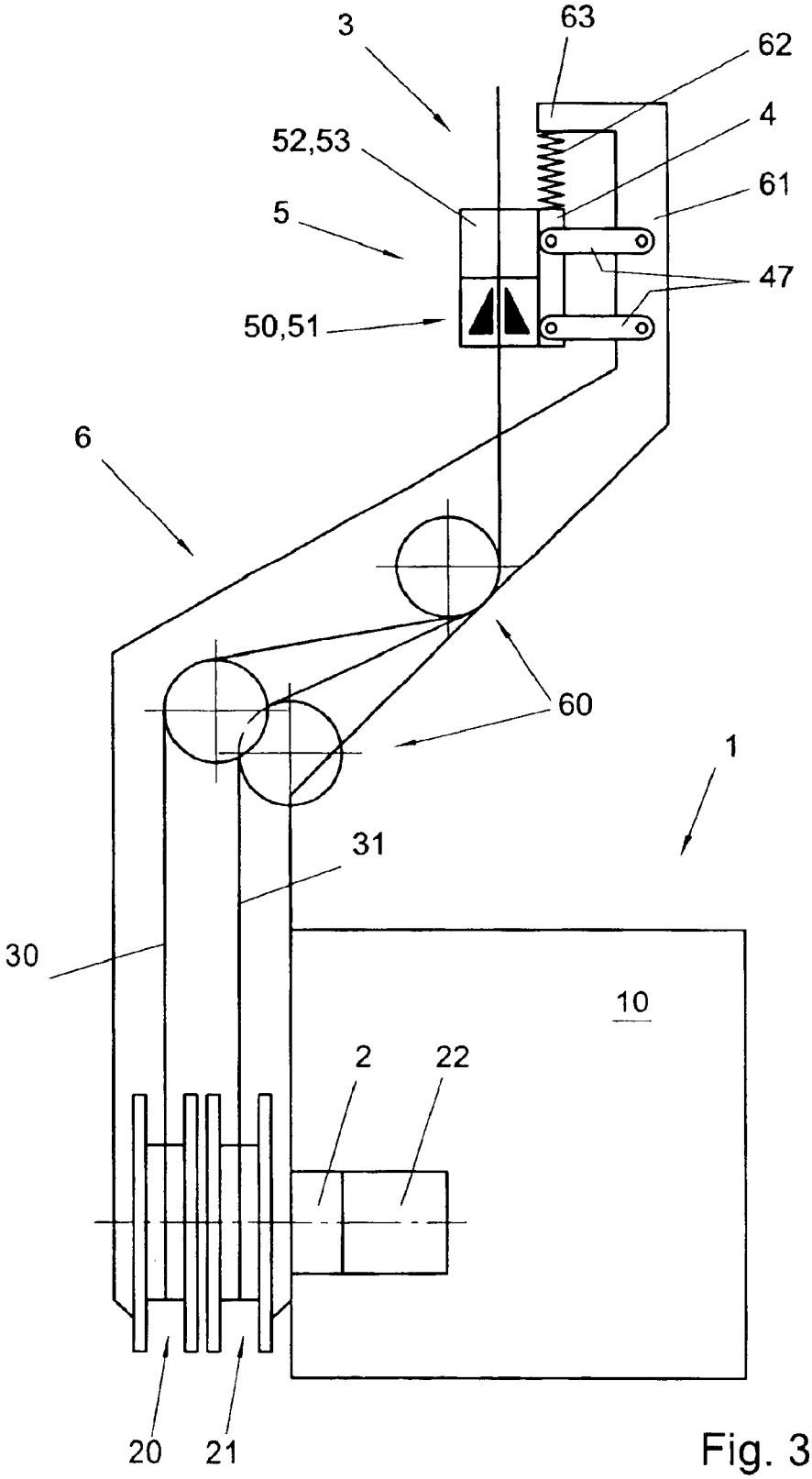
FIG. 3 represents a load equipped with a shock absorbing device according to a third embodiment.

FIG. 3 shows yet another embodiment, wherein the emergency braking device 5, as well as the shock absorbing device, are moved to one end of a support structure 6, having the shape of a gooseneck and rigidly fixed to the working platform 1. This type of construction of the working platform is generally used for very long working platforms, wherein the suspension points of the cable are not located at the two ends of the working platform, but are moved inwardly of the working platform. In this case, the axes of the motors 22, of the winding gears 2 and of the drums 20 and 21 or of the return pulleys, are positioned perpendicularly with respect to longitudinal axis of the working platform 1. In order to stabilise the working platform, the suspension cables 30 and 31 of each pair of cables are brought back as illustrated here into a plane containing the longitudinal axis of the working platform, by means of a support 6 having the shape of a gooseneck and of a set of pulleys 60. In an alternate version, the cables 30 and 31 of each pair could also be brought back into a plane perpendicular to the longitudinal axis of the working platform by support means 6 and pulleys 60 of the same type. The emergency braking device 5 includes, as previously, a braking device 50, 51 and a detector 52, 53 for each cable, installed on a mount 4 mounted movably with respect to a portion 61 of the support 6. One or more shock absorbers 62, mounted between the mount 4 carrying the braking device 5 and a fixed part 63 of the support 6 fulfil the same function as that described above.

FIG. 3 shows an alternate version of the device for fastening movably the mount 4 on the support structure 6 or on the working platform 1. In this alternate version, the relative movement of the mount 4 with respect to the portion 61 of the support 6 is achieved by means of a set of connecting rods 47 forming a deformable parallelogram.

Figure 4:
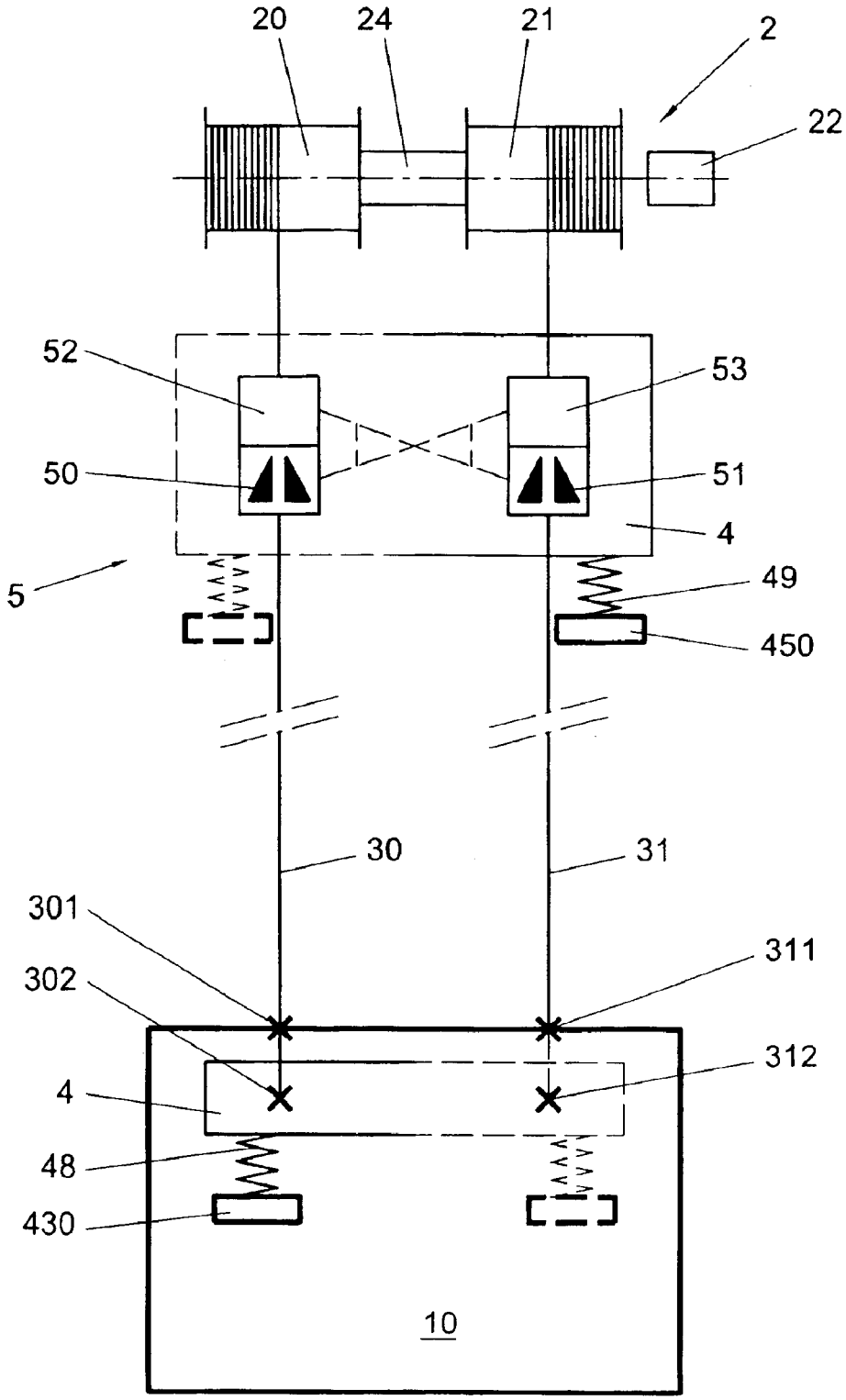
FIG. 4 represents a load equipped with a shock absorbing device according to a fourth embodiment.

Yet another embodiment is shown in FIG. 4, wherein the winding gear 2 comprising the two drums 20 and 21 driven by the motor 22 is placed on a fixed part of the installation, for example on the roof of the building serviced by the working platform 1. Preferably, the two drums 20 and 21 are driven by a single motor 22, while being coupled together by a differential device 24, as described, for example, in the application WO 01/38217.

In this embodiment and contrary to what was described previously, the braking device 5 including both the brakes 50 and 51 and the detectors 52 and 53, and functioning as described above, is also positioned on a fixed part of the installation, for instance on the same fixed part as that on which the winding gear 2 is mounted.

Furthermore, this figure illustrates two alternate versions for the positioning of the shock absorbing device. For example, the cable 30 is connected to the end face 10 of a working platform 1 via a mount 4, wherein the point of fixation of the cable to the mount is indicated by reference numeral 302, and said mount 4 is suspended on the working platform via a shock absorber 48 connected to a fixed point 430 of the working platform. In the other alternate version, the braking device ascribed to cable 31 is mounted on a mount 4, which is suspended to a fixed point 450 of the fixed part of the installation via one or more shock absorbers 49. In the latter case, the end of the cable 31 is fixed directly to the working platform 1 via the point of fixation 311. It is obvious that, in a given installation, the two cables 30 and 31 are connected to the working platform in the same manner, either directly via the points 301 and 302, with the mount 4 then supporting the two detectors 52, 53 and the two emergency brakes 50, 51 or via the mount 4 as indicated by the points of fixation 302 and 312.

The same alternate versions as those described in relation with either of the proposed embodiments are clearly transposable from one embodiment to another.

The following figures show an emergency braking device according to one preferred embodiment of the invention.

Figure 5:
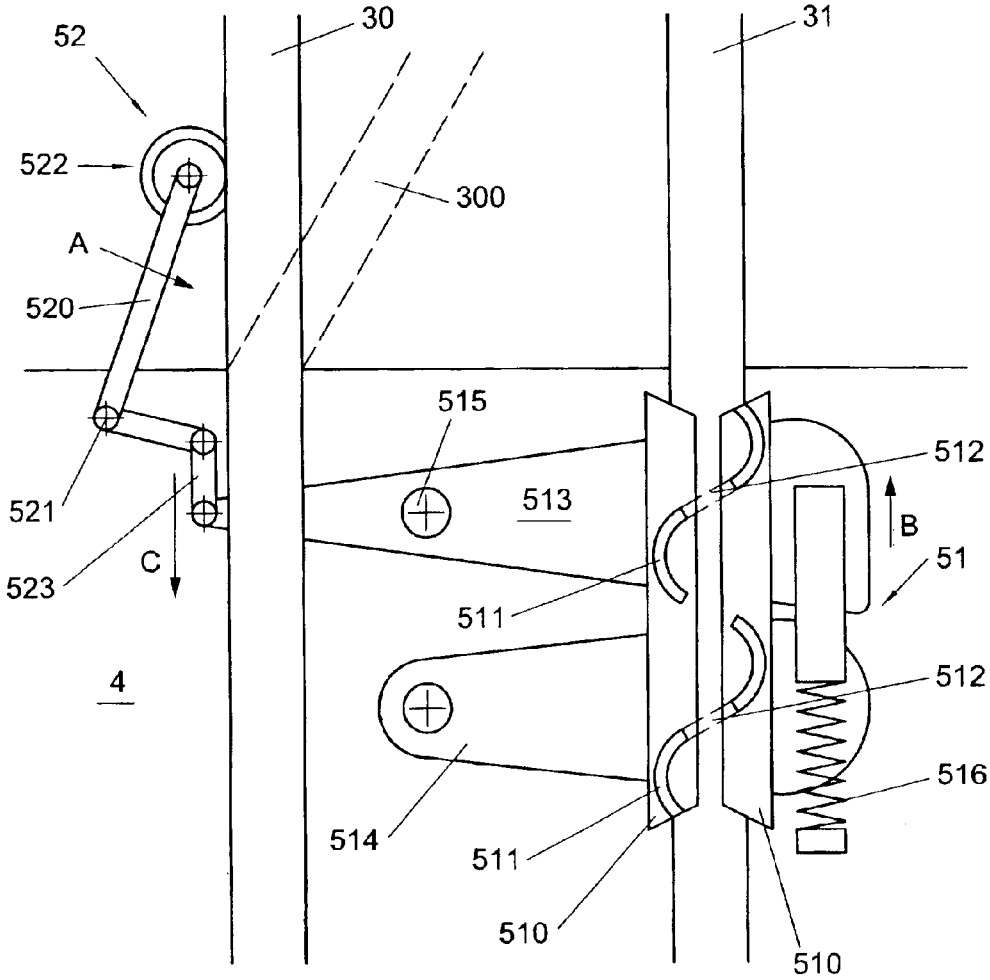
FIG. 5 represents schematically a first portion of a braking device according to a preferred embodiment of the invention.

FIG. 5 shows a portion of such a device, in which one can see a first detector for detecting a slack strand mounted on one of the cables and acting upon the other cable for the braking. The device is considerably simplified, to facilitate the understanding of its operations.

On the base 4, of which only a portion of the bottom is shown, one can see a first slack strand detector 52 which is capable of detecting the status of the tensile load exerted on the cable 30 and which controls the brake 51 acting upon the cable 31. The emergency brake 51 includes here two braking jaws 510 which are positioned on both sides of the cable 31 to clamp the same. Said jaws are provided with guiding ribs 511 capable of co-operating with corresponding oblique grooves 512 provided both on a braking lever 513 and on a support plate 514. The braking lever 513 is capable of pivoting about an axis 515 fixed to the mount 4, while being urged in the direction indicated by arrow B by a spring 516 supported by a fixed portion of the mount 4. The other end of the braking lever 513 is connected to the detector 52, which is in turn comprised of an actuator lever 520 mounted pivotally about an axis 521 fixed to the mount 4, a first end of said lever carrying a contact wheel 522 abutting against the cable 30, the other end of this lever being connected to the braking lever 513 via a connecting rod 523.

When the cable 30 is under a tensile load, the wheel 522 abuts against the periphery of this cable and any movement of the braking lever 513, which is urged by the spring 5516 in the direction of the arrow B, is prevented, thus keeping the jaws 510 in a position where they are spaced apart from each other In the case of a rupture of the cable 30, the contact wheel 522 is no longer retained in its position and the actuator lever 520 pivots about the axis 521 in the direction of the arrow A. Through the displacement of the levers and of the connecting rods, the braking lever 513 is no longer retained and it can pivot in the direction of the arrows B and C, under the action of the spring 516, and this pivoting motion brings together the two jaws 510, owing to the co-operation of the ribs 511 with the grooves 512 of the braking lever 513 and of the support plate 514.

Figure 6:
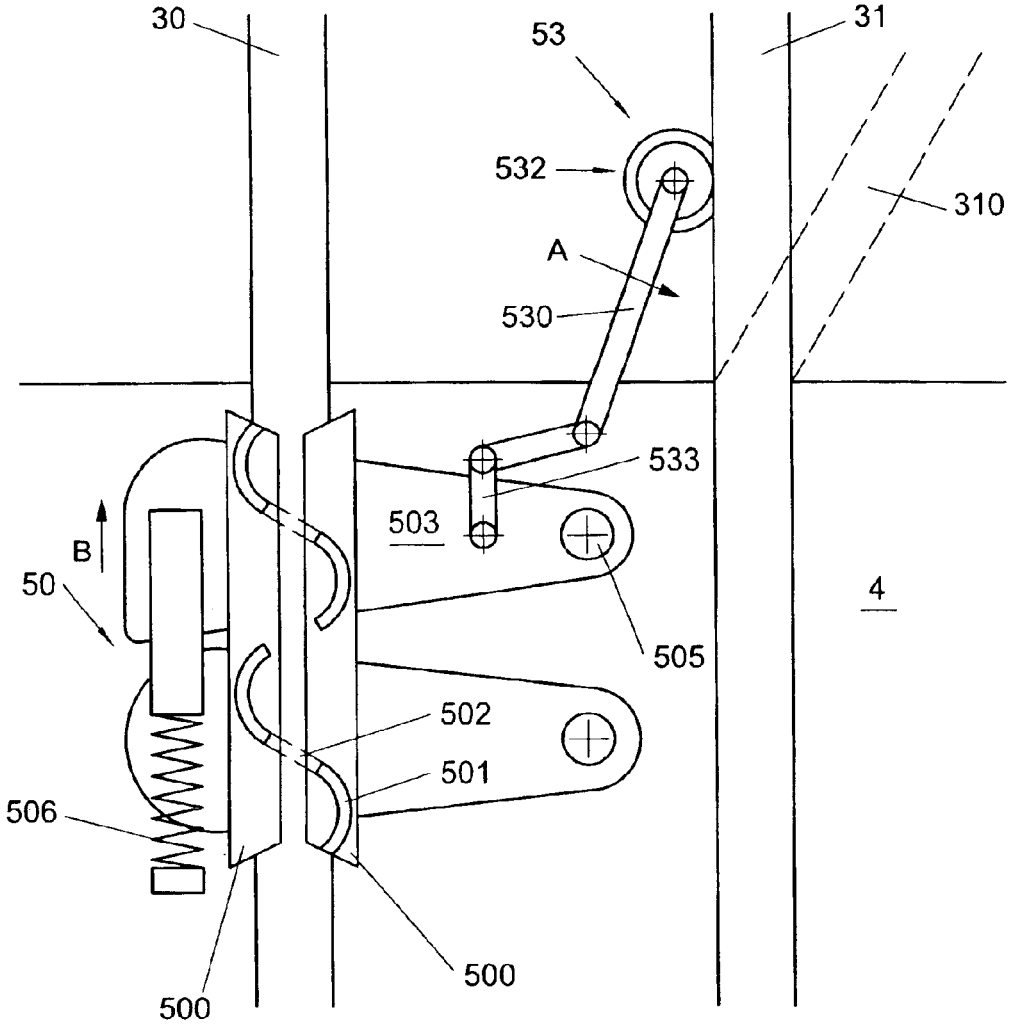
FIG. 6 represents schematically a second portion of the braking device of the previous figure.

FIG. 6 shows the corresponding portion of the braking device, including a second slack strand detector 53, which is capable of detecting the tensional status of the cable 31 and which is capable of actuating the brake 50 acting on the strand 30.

In a similar manner as described above, the loss of the tensile load on the cable 31 allows the pivoting of the lever 530 along the arrow A, which enables the braking lever 503 to pivot about the axis 505 under the action of the spring 506, and this makes it possible for the two jaws 500 to come together, while being guided by the ribs 501 and the grooves 502.

Accordingly, in the case of a rupture or of a decrease of the tension in one of the cables, the braking device acts immediately to stop the falling motion of the vehicle or of the working platform, by blocking the other cable.

Hence, it can be seen that the emergency braking device, as it is described above, satisfies entirely the requirements set out, namely to be capable of operating without an outside power supply or any other outside element and to be of a construction which is simple and which, accordingly, ensures that its operations proceed reliably and rapidly.

Another advantage of the emergency braking device as it is described, is apparent from FIGS. 5 and 6. In the case of a malfunction of the winding gear or gears controlling the cables 30 and 31, the working platform or the braking device affixed thereto can be brought into a strongly tilted position. This position is illustrated in the figures by the mount 4 being tilted relatively to the cable 300 and 301, indicated by phantom lines, with these two cables remaining oriented vertically. One can see that, in this case, the levers 520 and 530 can pivot as indicated by the arrows A, to actuate the clamping operation by the jaws 500 and 501, as described above, to bring to a halt the vehicle or the working platform. Accordingly, the system, as it is described, makes possible an emergency halt in the case of a malfunction of the winding gear or gears.

Alternate versions or constructions can be envisaged in relation to the examples mentioned hereabove: for instance, the mount 4 carrying the braking device was described as being connected to the working platform via a guiding system 40 and 41 or via connecting rods 47. Any other mechanical means allowing a relative movement of the mount 4 with respect to the working platform can be used. Also, the transmission between the slack strand detector 52 or 53 and the braking device 50 or 51 was described in a preferred embodiment; other constructional arrangements than those described can be used to produce the same effect.

Both the shock absorbing device and the emergency braking device have been described as being mounted on a working platform designed for maintenance work on facades; generally speaking, such devices can be mounted to operate as described on any vehicle, load or object pulled by, at least, one pair of cables subjected to the same tensile load, as for instance cable cars, funiculars, elevators, freight elevators and lifts. The term "vehicle" designates any mobile system, without this system necessarily transporting passengers.

It is clear that the shock absorbing device described can be mounted on a vehicle provided with an emergency braking device different from that described above and that the shock absorbing device can operate in the manner described even when the vehicle or the load is pulled or supported by a single cable. Similarly, the emergency braking device described can be mounted on a vehicle which does not include the shock absorbing device described above or which includes a shock absorbing device different from one of those described above.

Furthermore, the different alternate versions mentioned above have been described as being driven by one or two winding gears including one winding drum or two synchronised winding drums. Those skilled in the art will know how to adapt both the braking device and the shock absorbing device to any other configuration of the winding gear, of the drums and of the pulleys, of which the operations can be synchronised mechanically or electrically.

What is claimed is:

1. An emergency braking device capable of acting on a vehicle or on a load pulled or secured by at least two cables, subjected to tensile loads, which are identical under normal operating conditions, characterized in that said emergency braking device includes:

a first device for detecting a slack strand or the lacking of a tensile load in a first cable, which is capable of actuating a first braking means acting only upon a second cable, and a second device for detecting a slack strand or the lacking of a tensile load in said second cable, which is capable of actuating a second braking means acting only upon said first cable.

2. A braking device according to claim 1, characterized in that a transmission of an actuation command between the first device for detecting a slack strand or the lacking of a tensile load and the first braking means, and between the second device for detecting a slack strand or the lacking of a tensile load and the second braking means is carried out exclusively through mechanical means.

3. A braking device according to claim 2, characterized in that each device for detecting a slack strand or the lacking of a tensile load includes a first lever, and a second pivotal lever, one end of said first lever carries a contact wheel which is urged by a spring means against the cable which is monitored by the associated device for detecting a slack strand or the lacking of a tensile load, the other end of said first lever acting on said second pivotal lever normally maintaining two braking jaws in an unclamped position around the associated cable on which the braking is to be carried out, the disappearance of the bias exerted by the cable being monitored, enabling a rotation of said first lever as well as that of said second pivotal lever, resulting in the clamping of the cable to be braked by the two jaws, through the action of said spring means.

4. A braking device according to claim 3, characterized in that at least one of said first levers is designed in such a manner that a tilting of the braking device or of the vehicle to which the same is affixed, beyond a determined angle, causes an actuation of the associated braking means.

5. A braking device according to claim 1, characterized in that said emergency braking device further includes at least one shock absorbing device having at least one shock absorber placed between a mount and a fixed portion of an installation.

6. A braking device according to claim 5, characterized in that said fixed portion of an installation corresponds to a portion of the vehicle or of the load.

7. A braking device according to claim 5, characterized in that said fixed portion of an installation corresponds to a portion of a fixed environment of the vehicle or of the load.

8. A braking device according to claim 5, characterized in that the at least one shock absorber is designed for working in compression in a case of an actuation of the emergency braking device.

9. A braking device according to claim 5, characterized in that at least one hydraulic shock absorber is employed.

10. A braking device according to claim 5, characterized in that at least one shock absorber relying on a spring is employed.

11. A braking device according to claim 5, characterized in that at least one shock absorber relying on the compression of elastomers is employed.

12. A braking device according to claim 5, characterized in that said mount includes additionally the winding/unwinding gear or gears for said cables or a return pulley for said cable.

13. A braking device according to claim 5, characterized in that it constitutes a working platform adapted to be used for maintenance work on facades.

14. A braking device according to claim 1, characterized in that said emergency braking device is mounted on a mount including means for fastening the same to said vehicle or load, which are capable of allowing a relative movement between the mount and said vehicle or load, substantially in a direction of motion of said vehicle or load, with a range of said relative movement being limited.

15. A braking device according to claim 14, characterized in that the fastening means are slider means and guide means.

16. A braking device according to claim 14, characterized in that the fastening means include connecting rods forming a deformable parallelogram.

* * * * *